United States Patent [19]

Langan

[11] 4,399,625

[45] Aug. 23, 1983

[54] ROLL-ON PICTURE FRAME

[76] Inventor: Thomas R. Langan, 2801 Kennedy Blvd., E-10, Jersey City, N.J. 07306

[21] Appl. No.: 332,350

[22] Filed: Dec. 18, 1981

[51] Int. Cl.[3] ..... G09F 1/12

[52] U.S. Cl. ..... 40/155; 40/10 R; 40/152.1

[58] Field of Search ..... 40/155, 152, 10, 152.1

[56] References Cited

U.S. PATENT DOCUMENTS

| | | | |
|---|---|---|---|
| 1,132,366 | 3/1915 | Loewenthal | 40/155 |
| 1,170,137 | 2/1916 | Benton et al. | 40/155 |
| 2,777,232 | 1/1957 | Kulicke et al. | 40/155 |
| 4,064,644 | 12/1977 | Warner et al. | 40/152 |

*Primary Examiner*—Gene Mancene
*Assistant Examiner*—Wenceslao J. Contreras
*Attorney, Agent, or Firm*—Richard L. Miller

[57] ABSTRACT

A roll-on picture frame is provided whereby a one piece C-shaped channel is fitted around the perimeter of a sheet of clear plastic or thin glass, a picture or document and a back-up cardboard having a means for closing and securing the one piece C-shaped channel.

4 Claims, 8 Drawing Figures

ROLL-ON PICTURE FRAME

BACKGROUND OF THE INVENTION

The instant invention relates generally to picture frames. More specifically, it relates to a roll-on frame that can be applied by almost any one having normal use of their hands.

It is well known that to protect and preserve a photograph, document, picture or the like, a frame is provided. The frame must be the same size as the item or a mat must be used to compensate for size differences.

This situation is therefore in need of an improvement.

SUMMARY OF THE INVENTION

A principal object of the present invention is to provide a roll-on frame for snapshots, enlargements, post cards, pictures, documents and similar items, that is inexpensive.

Another object is to provide a roll-on frame that is an attractive decoration.

A further object is to provide a roll-on frame for oval, round, square cornered or odd shaped items that will fit perfectly.

A still further object is to provide a roll-on frame to be used in thermosetting operations to improve the manufacturing of mass-produced illustrations or documents.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

The Figures on the drawing is briefly described as follows.

DESCRIPTION OF THE PREFERRED EMBODIMENT

Figure 1:
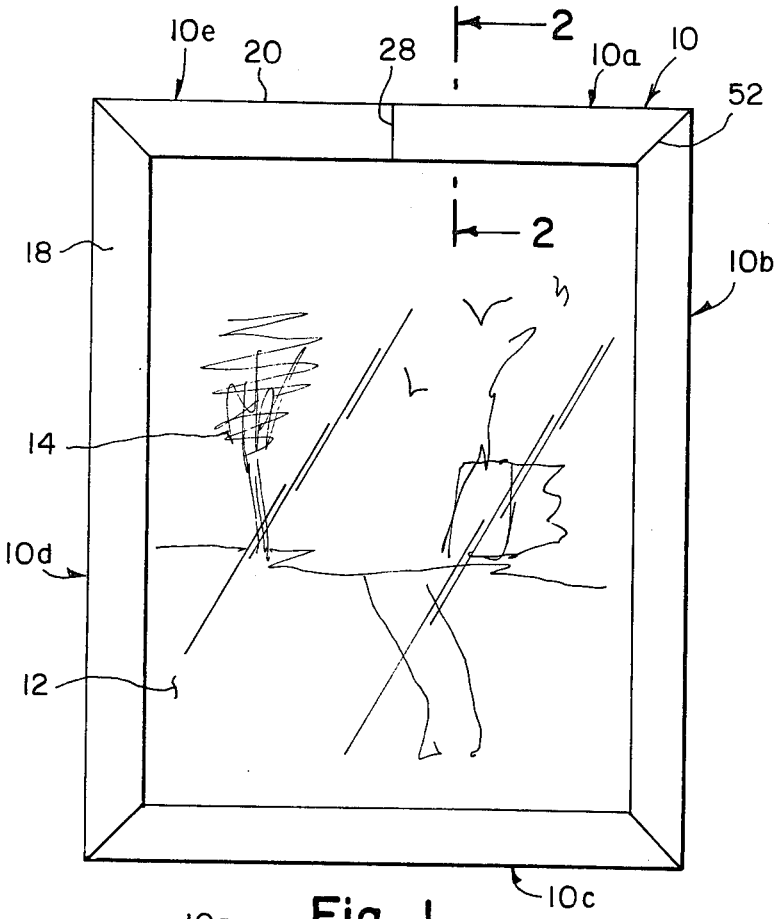
FIG. 1 is a front view of the invention installed on a picture.

Referring now to the drawing in greater detail, the reference numeral 10 represents the basic frame for the roll-on picture frame according to the present invention. A sheet of clear plastic or thin glass 12, a picture or document 14 and a back-up cardboard 16 is provided for framing.

The basic frame 10 is made of a suitably flexible plastic or metal and may be made in rolls of various lengths, depending on the size of the item to be framed. It may be made in stock rolls or pre-cut to standard lengths.

The basic frame 10 consists of a front wall 18, a top wall 20 and a rear wall 22 forming a C-shaped channel. The rear wall 22 has a continuous series of dovetails 24 and apertures 26. The dovetails 24 are formed by the cut out areas 25 in the rear wall 22. The space between front wall 18 and rear wall 22 should be approximately 1/16 of an inch to accommodate the picture or document 14 being framed, the back-up cardboard 16 and the sheet of clear plastic or thin glass 12.

Figure 4:
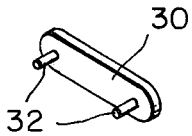
FIG. 4 is a perspective view of a typical buckle.
Figure 3:
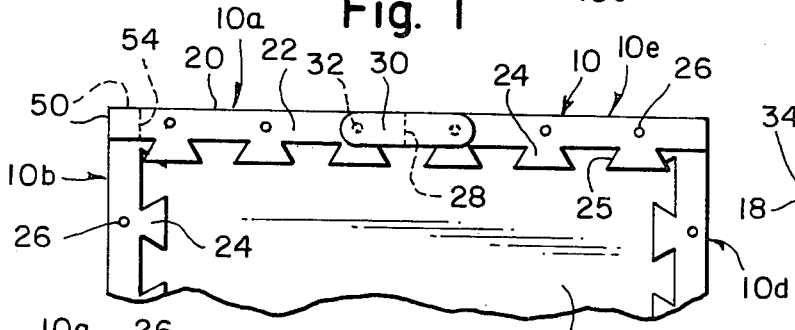
FIG. 3 is a partial back view of the invention.

FIG. 3 illustrates provisions in rear wall 22 of the basic frame 10 for closing and securing the frame once it has been applied to the picture or document 14. Beginning at the top center of the sheet of clear plastic or thin glass 12, the picture or document 14 and the back-up cardboard 16, the basic frame 10 is fitted around the perimeter being frames and cut at 28 as shown. A plastic or metal buckle 30 is used which has two pegs 32, as best seen in FIG. 4, to engage the nearest apertures 26 on each side of the cut 28 on the rear wall 22. A small rubberband or string 33 applied between the dovetails 24 on either side of the cut 28 may be used in place of the buckle 30, to close and secure the frame 10.

Figure 5:
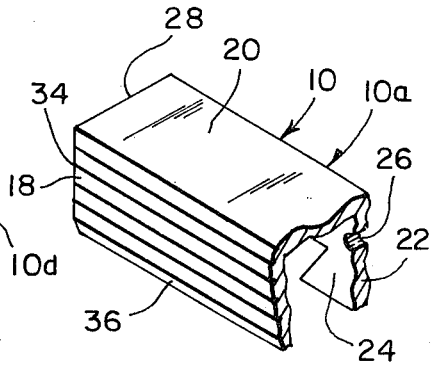
FIG. 5 is a partial perspective view of another form of the invention.
Figure 8:
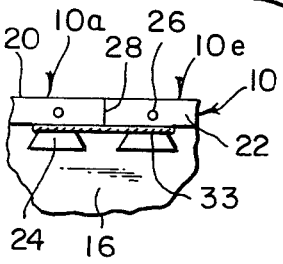
FIG. 8 is a partial back view of the invention showing another way to close and secure the frame.

FIG. 5 shows a few motifs which may decorate the basic frame 10. Fluting 34 and a bevel 36 is placed on the front surface of front wall 18. Jewel facets, crosses and other designs (not shown) may also be placed into the front wall 18. The basic frame 10 may be of clear plastic or finished in metallic tones, wood grains, embossing, etc. Framing made of suitable metal may also be worked in various patterns to enhance the appearance of the frame 10.

Figure 6:
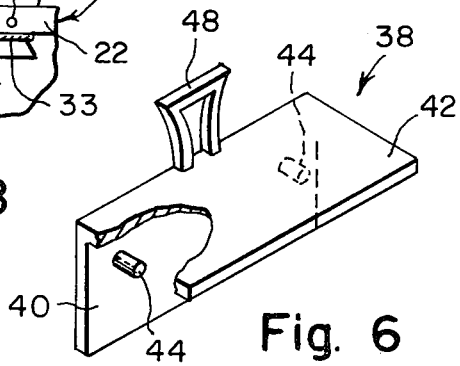
FIG. 6 is a broken away perspective view of a typical hanger.

FIG. 6 illustrates another type of buckle. This is a hanger 38 having a vertical wall 40 having two pegs 44 that engage the apertures 26 on each side of cut 28 in wall 22. A horizontal wall 42 affixed on one side to the top of wall 40 has a handle 46 affixed to it, to enable the picture and frame to hang on a wall (not shown).

Figure 7:
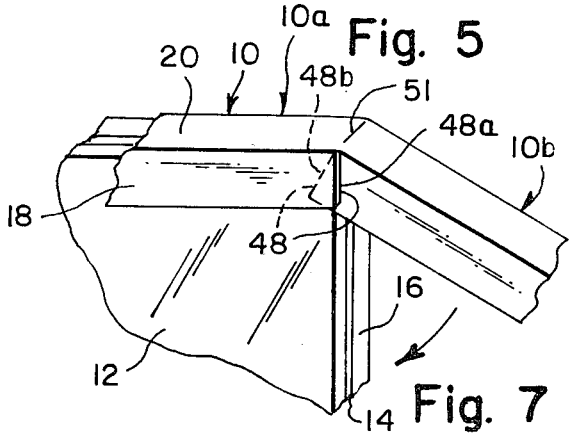
FIG. 7 is a partial perspective view of a corner of a picture showing how to bend the frame for mitering the corner.

FIG. 7 shows the basic frame 10 being bent at a corner. Front wall 18 is cut at 48 and rear wall 22 is cut at 50 as seen in FIG. 3. The top wall 20 is bent at line 51 with the cut edge **48*b* going to the underside of the basic frame segment 10*a* and the cut edge 48*a* overlapping the cut edge 48*b* until the basic frame segment 10*b* is in a vertical position. By cutting front wall 18 of basic frame segment 10*a* at 52 as seen in FIG. 1, the corner can be mitered neatly. Rear wall 22** need not be mitered.

This method of cornering and mitering the basic frame 10 can be repeated at the corner of basic frame segments **10*b* and 10*c*, 10*c* and 10*d* and 10*d* and 10*e* as shown in FIG. 1. By applying a suitable adhesive 54 to the overlap of side 22 at each corner the basic frame 10** will have more strength and rigidity.

Figure 2:
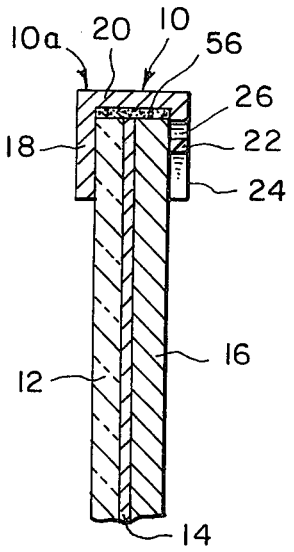
FIG. 2 is a cross sectional view taken on line 2—2 of FIG. 1.

As shown in FIG. 2, when square cornered pictures or illustrations are framed, two sided adhesive tape 56 may be used on the inner side of the top wall 20, if the framing tends to bow out.

While certain novel features of this invention have been shown and described and are pointed out in the annexed claims, it will be understood that various omissions, substitutions and changes in the forms and details of the device illustrated and in its operation can be made by those skilled in the art with out departing from the spirit of the invention.

What is claimed is:

1. A roll-on picture frame which comprises:

(a) a one piece C-shaped channel fitted around the perimeter of a sheet of clear plastic or thin glass, a picture or document and a back-up cardboard;

(b) a means for closing and securing said one piece C-channel, in which said one piece C-shaped channel comprises:

(c) a front wall;

(d) a rear wall having a continuous series of apertures on dovetails, said dovetails formed by cut out areas in said wall; and (e) a top wall affixed to said front wall and said rear wall.

2. A roll-on picture frame as recited in claim 1, in which said means for closing and securing said one piece C-shaped channel comprises:

(a) a buckle; and (b) two pegs mounted perpendicularly on said buckle and spaced apart to engage the nearest said apertures on each side of the cut ends of said rear wall of said one piece C-shaped channel.

3. A roll-on picture frame as recited in claim 1 in which said means for closing and securing said one piece C-shaped channel comprises:

(a) a vertical wall;

(b) two pegs mounted perpendicular on said vertical wall and spaced apart to engage the nearest said apertures on each side of the cut ends of said rear wall of said one piece C-shaped channel;

(c) a horizontal wall affixed on one side to the top of said vertical wall;

(d) a handle affixed to the rear top surface of said horizontal wall to enable said one piece C-shaped channel to hang on a wall.

4. A roll-on picture frame as recited in claim 1, in which said means for closing and securing said one piece C-shaped channel is a rubberband or string to engage the nearest said dovetails on each side of the cut ends of said rear wall of said one piece C-shaped channel.

* * * * *